US007343898B1

(12) United States Patent
Caldwell et al.

(10) Patent No.: US 7,343,898 B1
(45) Date of Patent: Mar. 18, 2008

(54) AIR VANE GOVERNOR

(75) Inventors: Ricky Caldwell, Palmersville, TN (US); Jason Walker, Dexter, KY (US); Daron Wilson, Hazel, KY (US); Scott Benson, Murray, KY (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 11/674,466

(22) Filed: Feb. 13, 2007

(51) Int. Cl.
*F02D 31/00* (2006.01)

(52) U.S. Cl. ..... 123/376; 123/396; 123/400

(58) Field of Classification Search ..... 123/376, 123/396, 400
See application file for complete search history.

(56) References Cited

U.S. PATENT DOCUMENTS

| | | | | |
|---|---|---|---|---|
| 2,529,243 | A | 11/1950 | Brown et al. | |
| 2,803,757 | A | 8/1957 | McFarland | |
| 3,092,084 | A | 6/1963 | Thorner | |
| 3,276,439 | A | 10/1966 | Reichenbach | |
| 3,721,309 | A | 3/1973 | Donaldson | |
| 4,023,550 | A * | 5/1977 | Houston | 123/198 D |
| 4,221,202 | A * | 9/1980 | Wick | 123/378 |
| 4,300,506 | A | 11/1981 | Knapp et al. | |
| 4,351,279 | A * | 9/1982 | Wick | 123/391 |
| 4,354,461 | A * | 10/1982 | Heismann et al. | 123/195 AC |
| 4,359,990 | A | 11/1982 | Kromer et al. | |
| 4,455,978 | A | 6/1984 | Atago et al. | |
| 4,517,942 | A | 5/1985 | Pirkey et al. | |
| 4,773,371 | A | 9/1988 | Stenz | |
| 4,836,167 | A | 6/1989 | Huffman et al. | |
| 5,003,949 | A | 4/1991 | Fanner et al. | |
| 5,131,360 | A | 7/1992 | Muschalik | |
| 5,146,889 | A | 9/1992 | Swanson et al. | |
| 5,195,490 | A | 3/1993 | Maier | |
| 5,503,125 | A | 4/1996 | Gund | |

* cited by examiner

*Primary Examiner*—Erick Solis
(74) *Attorney, Agent, or Firm*—Michael Best & Friedrich LLP

(57) ABSTRACT

An engine includes a stationary member, a crankshaft supported for rotation by the stationary member, and a flywheel rotatable in response to rotation of the crankshaft. A fan has a plurality of fins and is rotatable in response to movement of the flywheel. A movable air vane includes a surface that deflects air from the fins as the fins move with the flywheel. The engine also includes an intake passageway for intake air and a throttle lever including a throttle pivot point and a throttle linkage aperture. The throttle linkage aperture and the throttle pivot point define a first axis having a first side and a second side. A throttle valve is disposed in the intake passageway to control the flow of intake air. The throttle valve is movable in response to movement of the throttle lever. A throttle linkage is positioned to directly or indirectly connect the air vane and the throttle lever. The throttle linkage and the movable air vane are disposed on the first side of the first axis. A resilient member is directly or indirectly connected to the stationary member and the throttle lever at a resilient member aperture that is located on the throttle lever on the second side of the first axis. The resilient member applies a force to bias the throttle lever in a first direction away from the flywheel.

25 Claims, 5 Drawing Sheets

AIR VANE GOVERNOR

BACKGROUND

This invention relates to a governor for an internal combustion engine. More specifically, the invention relates to an air vane governor.

Governors are known for internal combustion engines to govern engine speed. Different types of governors may be used in different engines, including flyweight governors and air vane governors. An air vane governor typically includes a rotatable flywheel or other support member that supports a fan having a plurality of spaced apart fins that rotate with the flywheel. As the fins rotate, they generate an air flow that is deflected by a pivotable air vane. A resilient member, such as a governor spring, opposes the movement of the air vane, such that the governed speed is determined by the interplay between the movement of the air vane and the spring force of the governor spring.

In typical air vane governors, the governor spring is attached to the linkage between the air vane and the throttle valve. When the spring is attached to the linkage, the spring exerts a side force on the linkage. This side force can cause the linkage to rotate or bind, which can affect the stability of the governor and cause problems, such as hunting or surging in the engine.

The speed of the engine typically drops when a load is applied to the engine. This drop in engine speed is called "speed droop" and is a characteristic of a particular engine. The speed droop is determined, in part, by the spring rate and tension applied to the governor spring. Speed droop causes a loss of horsepower in the engine and can affect the reliable function of the engine, especially under certain engine conditions.

SUMMARY

In one embodiment, the invention provides an engine that includes a stationary member, a crankshaft supported for rotation by the stationary member, and a flywheel rotatable in response to rotation of the crankshaft. A fan has a plurality of fins and is rotatable in response to movement of the flywheel. A movable air vane includes a surface that deflects air from the fins as the fins move with the flywheel. The engine also includes an intake passageway for intake air and a throttle lever including a throttle pivot point and a throttle linkage aperture. The throttle linkage aperture and the throttle pivot point define a first axis having a first side and a second side. A throttle valve is disposed in the intake passageway to control the flow of intake air. The throttle valve is movable in response to movement of the throttle lever. A throttle linkage is positioned to directly or indirectly connect the air vane and the throttle lever. The throttle linkage and the movable air vane are disposed on the first side of the first axis. A resilient member is directly or indirectly connected to the stationary member and the throttle lever at a resilient member aperture that is located on the throttle lever on the second side of the first axis. The resilient member is configured to apply a force to bias the throttle lever, and the resilient member aperture in the throttle lever, in a first direction away from the flywheel.

In another construction, the invention provides an engine that includes a stationary member, a crankshaft supported for rotation by the stationary member, an intake passageway for intake air, and a throttle valve disposed in the intake passageway to control the air flow through the passageway into the engine. A throttle lever is pivotable about a pivot point to move the throttle valve and an air vane governor includes a movable air vane. The movable air vane is operable to pivot the throttle lever between a first position and a second position. A single resilient member forms at least a portion of a connection between the stationary member and the throttle lever. The resilient member applies a force to the throttle lever to bias the throttle lever toward a wide open position.

In yet another construction, the invention provides an engine that includes a stationary portion and a crankshaft supported by the stationary portion and rotatable at a first speed in response to the combustion of an air-fuel mixture. A fan is rotatable at a second speed that is proportional to the first speed in response to rotation of the crankshaft and an air vane is positioned adjacent the fan and is pivotable about a pivot axis in response to rotation of the fan. A throttle lever is pivotally supported for rotation about a throttle axis and includes a throttle linkage aperture that cooperates with the throttle axis to define a first axis having a first side and a second side. The throttle lever is movable between a first position and a second position to vary the first speed. A linkage forms at least a portion of a connection between the air vane and the throttle lever such that the throttle lever moves in response to movement of the air vane. The linkage and the air vane are disposed on the first side of the first axis. A resilient member forms at least a portion of a connection between the stationary member and the throttle lever. The resilient member is disposed on the second side of the first axis.

Further constructions and advantages of the present invention, together with the organization and manner of operation thereof, will become apparent from the following detailed description of the invention when taken in conjunction with the accompanying drawings, wherein like elements have like numerals throughout the drawings.

Other aspects of the invention will become apparent by consideration of the detailed description and accompanying drawings.

BRIEF DESCRIPTION OF THE DRAWINGS

The present invention is further described with reference to the accompanying drawings, which show some embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
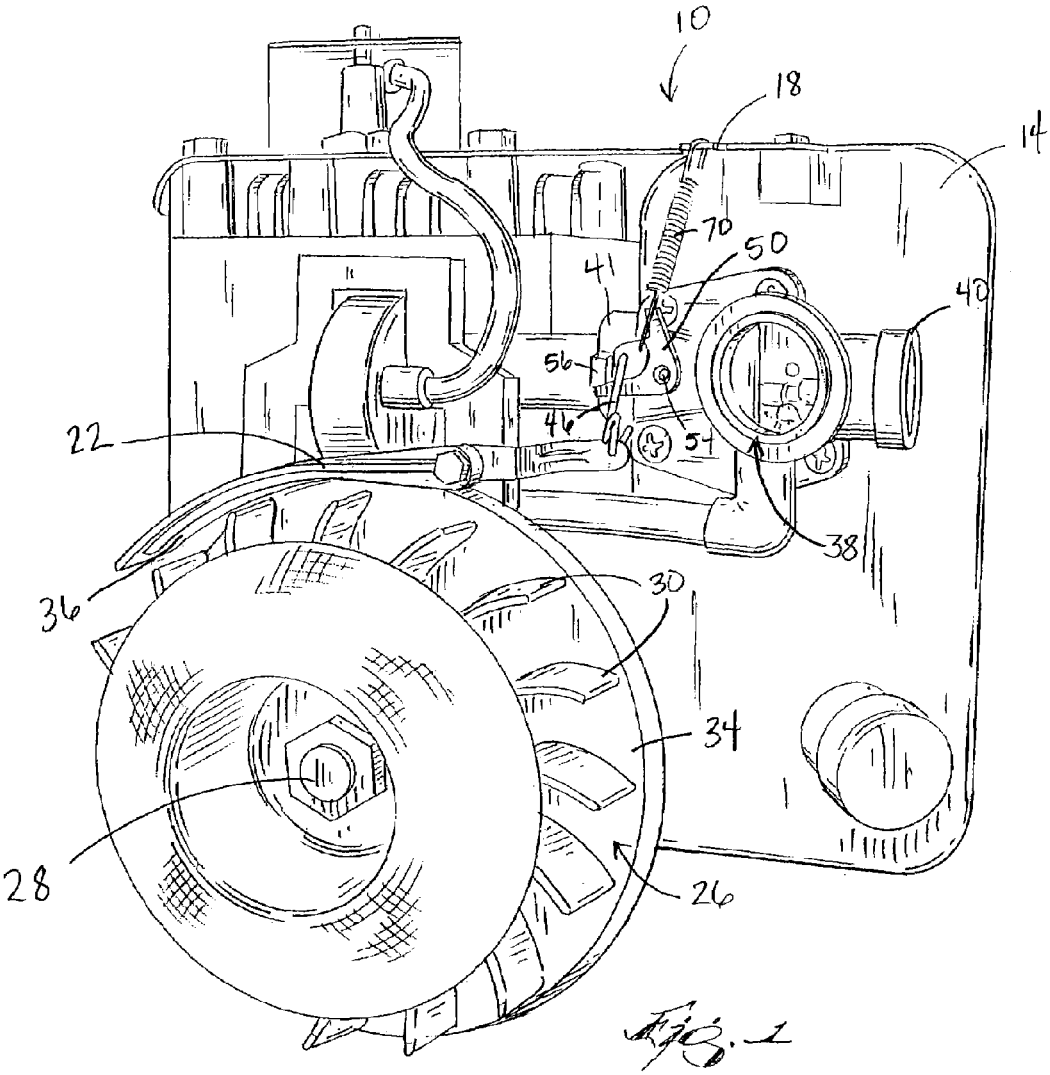
FIG. 1 is a top perspective view of an engine according to the present invention.

FIG. 1 illustrates an internal combustion engine 10 according to one embodiment of the present invention. The engine 10 includes a stationary portion that includes an engine housing, a fuel tank 14, and a bracket 18. In the illustrated construction, the bracket 18 attaches to the fuel tank 14. The engine 10 also includes an air vane 22. The air vane 22 moves in response to air flow produced by a fan 26 coupled to the engine crankshaft 28, and rotates with the crankshaft. In this way, the air vane 22 moves as a function of the engine speed. The fan 26 includes a plurality of fins 30 and is interconnected with a flywheel 34 of the engine 10. The air vane includes a surface 36 that deflects air from the fins 30 as the fins 30 move with the flywheel 34.

The engine 10 further includes an intake passageway 38 through which air travels into the combustion chamber of the engine 10. The intake passageway 38 includes an intake end 40 and an exhaust end 41. The air flow through the intake passageway 38 is controlled by a throttle valve 42 (shown in phantom in FIG. 5) in that the throttle valve 42 controls how much air passes through the exhaust end 41 of the intake passageway 38 into the engine 10. The throttle valve 42 and the air vane 22 are mechanically coupled together such that movement of the air vane 22 changes the position of the throttle valve 42 within the intake passageway 38.

Figure 2:
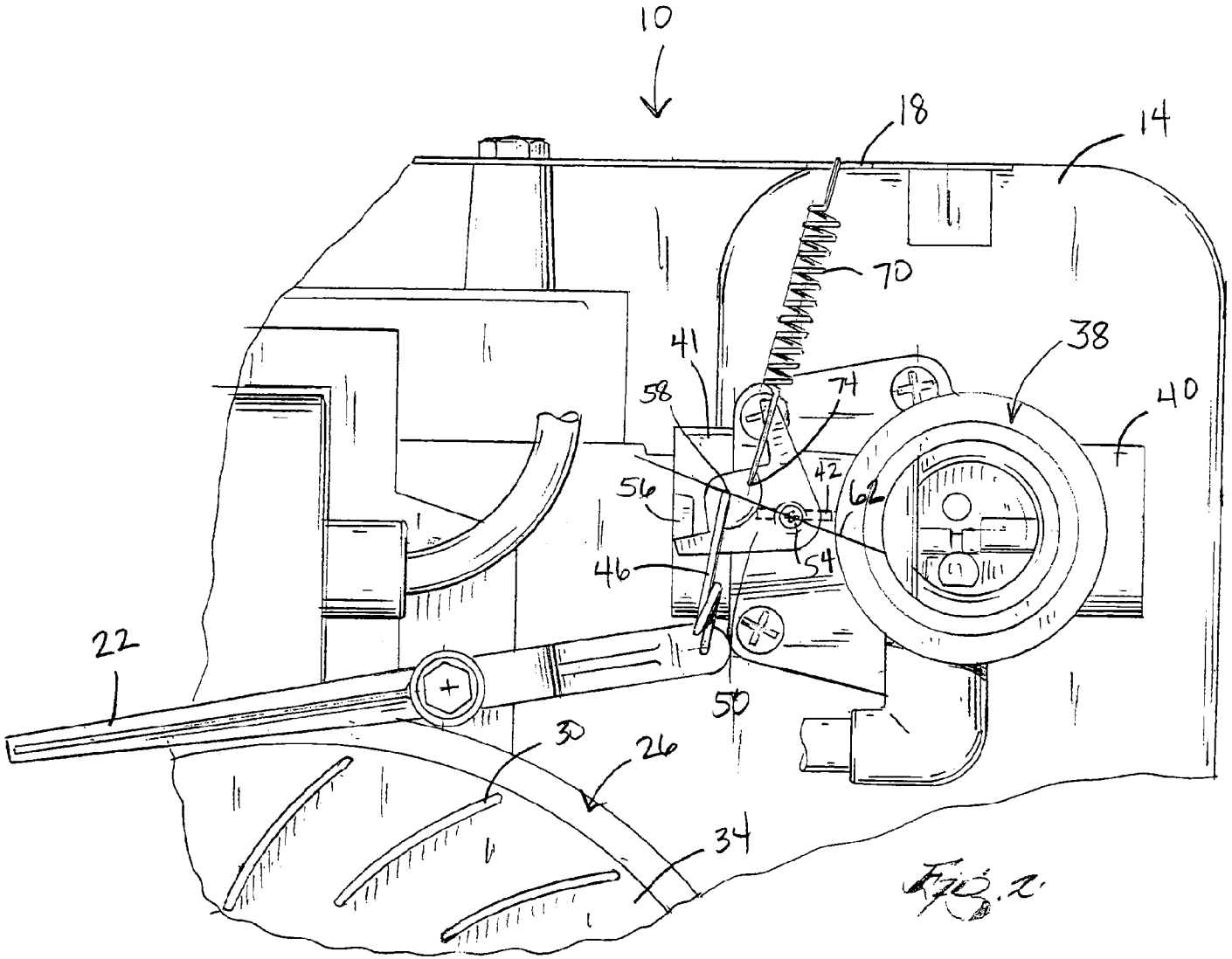
FIG. 2 is top view of a portion of the engine of FIG. 1, illustrating the throttle lever in the wide open throttle position.
Figure 3:
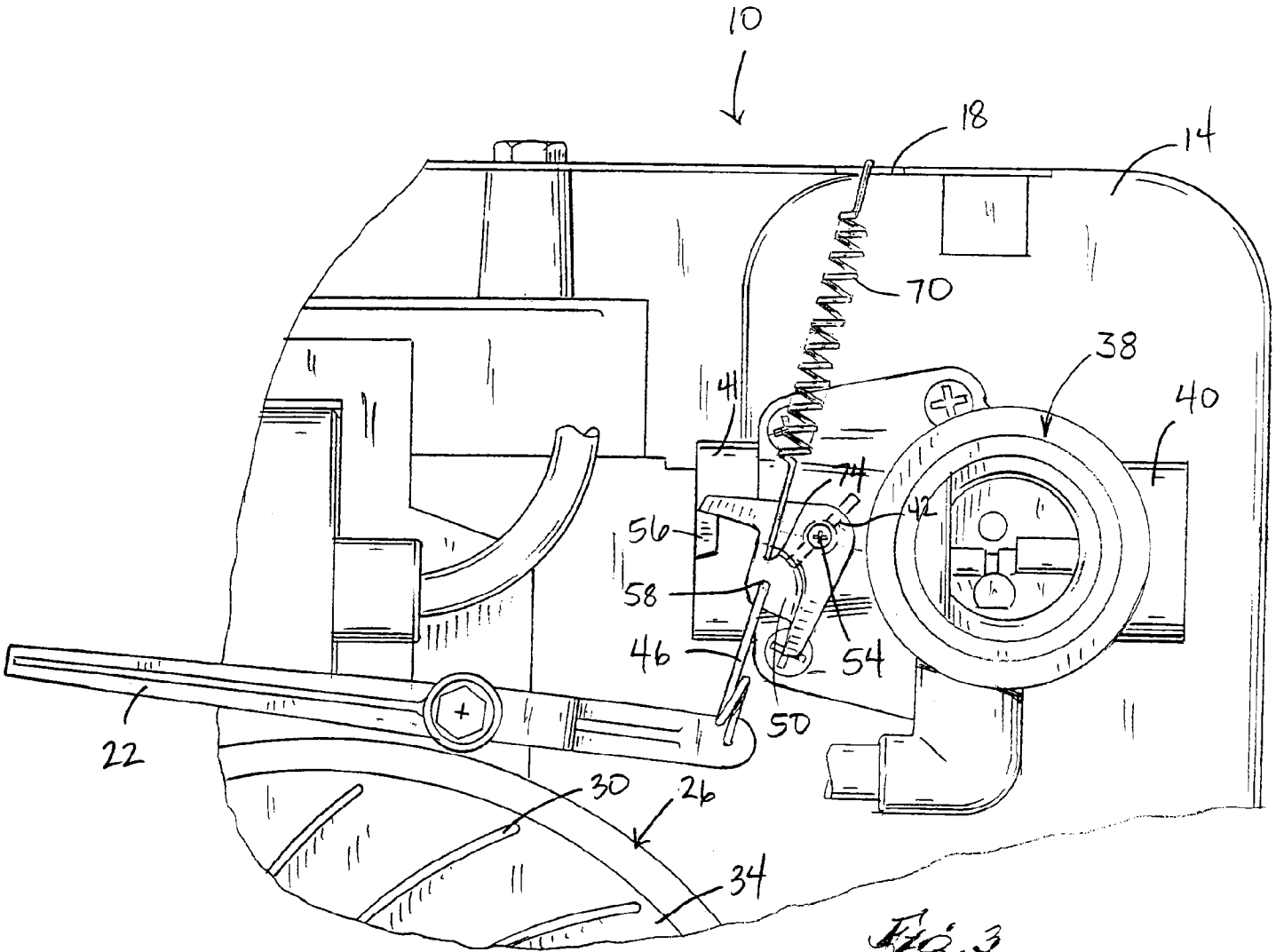
FIG. 3 is a top view similar to FIG. 2, illustrating the throttle lever in the closed position.

With reference to FIGS. 2 and 3, the engine 10 includes a throttle linkage that is interconnected between the air vane 22 and a throttle lever 50. In the illustrated embodiment, the throttle linkage includes a single throttle link 46, but it is understood that in other embodiments, the throttle linkage could have a different configuration. The throttle lever 50 pivots about a throttle pivot point 54, and movement of the throttle lever 50 moves the throttle valve 42. The throttle valve 42 is movable between a wide open throttle position and a high speed no load or closed position. Since the throttle lever 50 is movable with the throttle valve 42, the throttle lever 50 is movable between a position corresponding to the wide open throttle position of the throttle valve 42, illustrated in FIGS. 2 and 4, and a closed position corresponding to the high speed no load throttle position of the throttle valve 42, illustrated in FIGS. 3 and 5. For the remainder of this application, we will refer to the positions of the throttle lever 50 as the wide open throttle position and the closed position, it being understood that the throttle is not completely closed in the high speed no load or closed position. A stop tab 56 located on the exhaust end 41 of the intake passageway 38 prevents the throttle lever 50 from overrotating in either direction.

Figure 4:
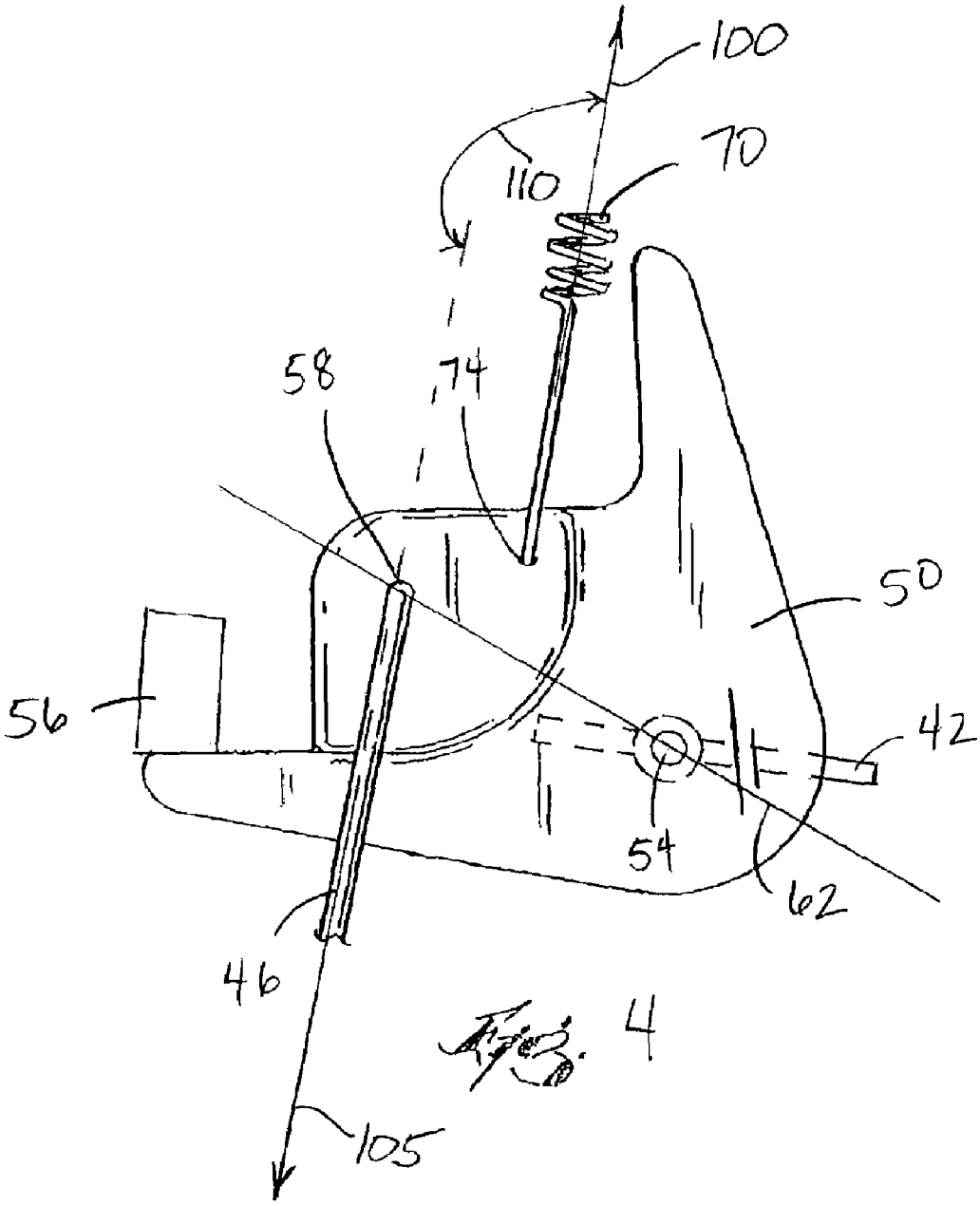
FIG. 4 is a top view of the throttle lever in the wide open throttle position.

The throttle link 46 is attached to the throttle lever 50 at a throttle link aperture 58. As illustrated in FIG. 4, the throttle link aperture 58 and the throttle pivot point 54 define a first axis 62 that defines a first side and a second side. The throttle link 46 is positioned on the first side of the first axis 62 along with the air vane 22.

A resilient member is interconnected (that is, either directly or indirectly connected) between the bracket 18 and the throttle lever 50. The resilient member is connected to the throttle lever 50 at a resilient member aperture 74 on throttle lever 50. The resilient member applies a force to the throttle lever 50 that is directed generally away from the flywheel 34. Thus, the force opposes movement of the air vane 22 when the air vane 22 moves in one direction, and aids movement of the air vane 22 when the air vane 22 moves in the opposite direction. In the illustrated embodiment, the resilient member includes a spring 70. However, it is understood that in other embodiments, other types of resilient members such as torsion springs and compression springs, or multi-piece resilient members can be utilized, and also that the resilient member can be connected to portions of the fuel tank 14 other than the bracket 18. In some embodiments, the resilient member could be attached to an adjustable bracket on the stationary portion of the engine 10. Attaching the spring 70 to the throttle lever 50 eliminates the binding problems discussed above with respect to governors where the spring is attached to the throttle linkage. This makes the governing more stable and allows for less speed droop in the engine. With reference again to FIG. 4, the resilient member aperture 74 is located on the second side of the first axis 62 rather than on the first side with the throttle link 46.

The location of the resilient member aperture 74 affects the amount of droop in the engine 10, thereby affecting the stability of the governor. Locating the resilient member aperture 74 on the same side of the first axis 62 as the throttle link 46 increases the chance of the spring binding as the throttle lever 50 and the spring 70 are moved towards an overcenter position. To reduce the risk of binding, the resilient member aperture 74 is located on the opposite side of the first axis 62 from the throttle link 46. While it is understood that other locations of the aperture 74 on the opposite side of the first axis 62 are possible and still fall within the present invention, the location of the aperture 74 illustrated in FIGS. 4 and 5 minimizes the droop within the engine 10 while utilizing a spring 70 of similar length and spring rate to what is currently used in other governor designs, thus increasing the stability of the governor.

The size of the resilient member aperture 74 also affects the amount of droop in the engine 10 as well. If the aperture is too small, the manufacturability of the throttle lever 50 becomes more difficult, due to the tolerances of the machines. If the aperture is too large, the position of the spring 70 will change as the throttle lever 50 moves between the wide open throttle position and the closed position, due to the spring 70 sliding within the aperture. The change of position within the aperture can increase the droop in the engine. The diameter of the aperture 74 in the present invention should be between 0.041 inches (1.04 mm) and 0.060 inches (1.52 mm). In a preferred embodiment, the diameter is equal to 0.060 inches (1.52 mm).

Figure 5:
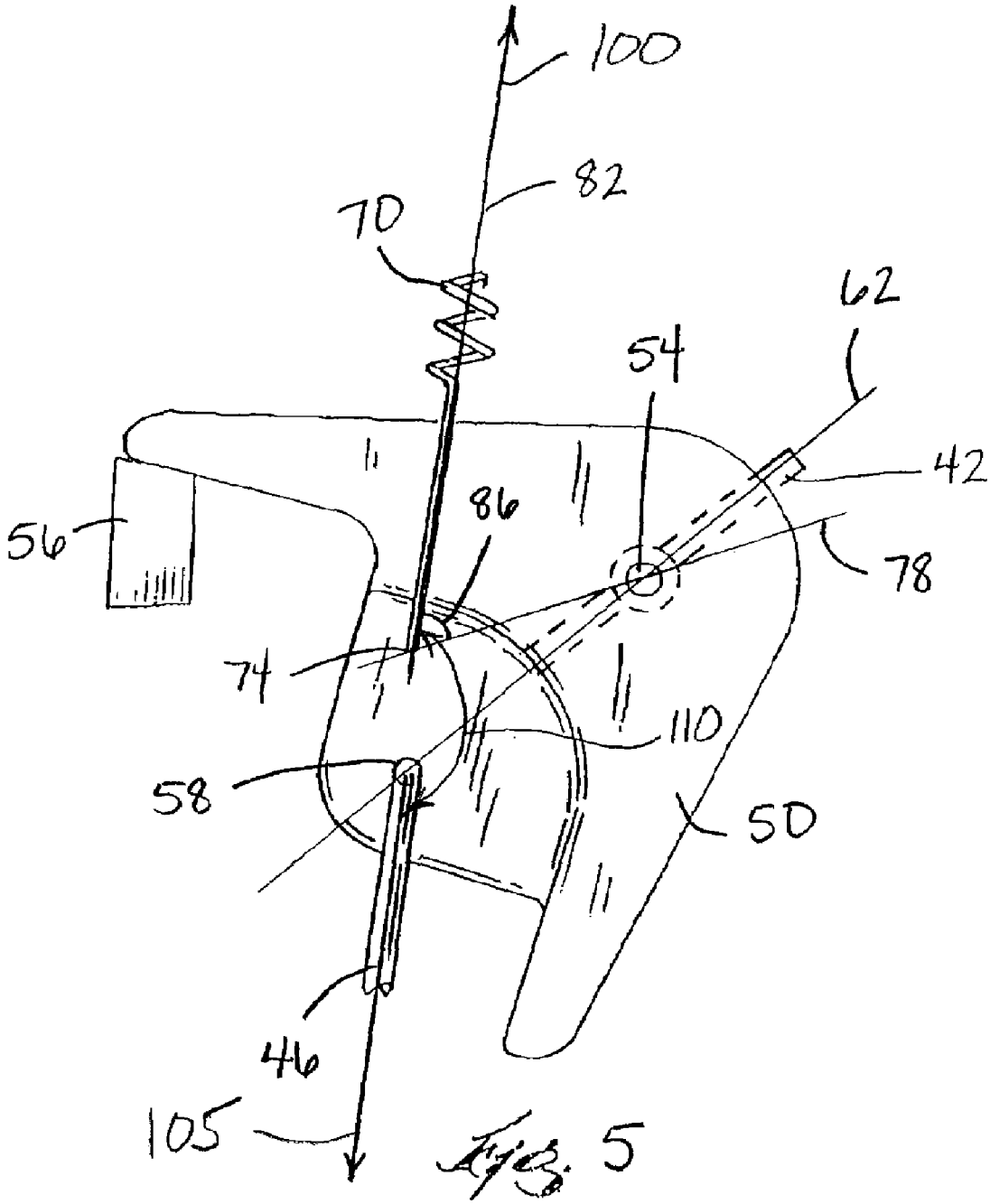
FIG. 5 is a top view of the throttle lever in the closed position, illustrating the throttle.

The resilient member aperture 74 and the throttle pivot point 54 define a second axis 78, and the spring 70 defines a third axis 82. As illustrated in FIG. 5, an angle 86 between the second axis 78 and third axis 82 is less than ninety degrees when the throttle lever 50 is in the closed position. In the illustrated embodiment, the angle 86 is equal to sixty-five degrees. By maintaining the angle 86 less than ninety degrees, the stability of the governor is optimized.

In operation, the engine 10 combusts an air-fuel mixture to produce rotation of the crankshaft. The rotation of the crankshaft produces a rotation of the fan 26 at a speed that is proportional to the speed of the crankshaft. The air vane 22 deflects in response to the flow of air from the fan 26 to move the linkage or throttle link 46, which in turn pivots the throttle lever 50 to vary the flow of the air-fuel mixture and thus the speed of the engine 10. The spring 70 applies a force to the throttle lever 50 in a direction 100 that would move the throttle toward the wide open position (shown in FIG. 4). The spring 70 also applies a force to bias the resilient member aperture 74 in a direction away from the flywheel 34. When a load is applied to the engine 10, the initial reaction of the engine 10 is to slow down. As the engine 10 slows, less air is blown onto the air vane 22 and its deflection is reduced. The spring 70 pulls the throttle lever 50 in a direction 100 that opens the throttle to increase the flow of the air-fuel mixture to the engine 10. The increased flow of air-fuel causes an increase in the speed of the engine 10. As the speed increases, additional air impinges on the air vane 22, thereby deflecting the air vane 22 outward. This movement of the air vane 22 causes a corresponding movement of the throttle lever 50 in a direction 105 opposite the force applied by the spring 70. The movement continues until the force produced by the spring 70 and the force applied by the air vane 22 are balanced about the pivot point 54 of the throttle lever 50.

As illustrated in FIGS. 4 and 5, the arrangement of the throttle lever 50, the spring 70, and the throttle link 46 is such that the throttle link 46 and the spring 70 extend in opposite directions 100, 105. For example, FIG. 4 illustrates the throttle lever 50 in the wide open throttle position. As illustrated, the throttle link 46 extends in the direction 105 and the spring 70 extends in direction 100 that is substantially opposite direction 105. In the illustrated construction, an angle 110 between the direction 100 and the direction 105 is substantially 0 or 180 degrees (i.e., the directions 100, 105 are substantially parallel), and preferably is less than 30 degrees. With the throttle lever 105 in the high-speed no-load or closed position illustrated in FIG. 5, the throttle link 46 again extends in the direction 105 and the spring 100 extends in direction 100 that is substantially opposite and parallel to direction 105. As illustrated, the angle 110 between the direction 100 and the direction 105 remains below 30 degrees throughout the motion of the throttle lever 50.

It should be noted that the throttle link 46 may be just one component of a linkage and the spring 70 may be just one component of a biasing member. As such, the linkage and biasing member are described herein as forming at least a portion of a connection between two components. This terminology should be read to include constructions in which a single link (e.g., throttle link 46) and/or a single biasing member (e.g., spring 70) forms the entire connection and thus directly connects the two components. This terminology should also be read to include constructions in which the linkage includes several components directly connected to each other or connected to each other through one or more intermediate components, and the biasing member is but one of several components that are connected to one another to complete the connection between the two components.

Various features of the invention are set forth in the following claims.

What is claimed is:

1. An engine comprising:

a stationary member;

a crankshaft supported for rotation by the stationary member;

a flywheel rotatable in response to rotation of the crankshaft;

a fan having a plurality of fins, the fan rotatable in response to movement of the flywheel;

a movable air vane having a surface that deflects air from the fins as the fins move with the flywheel;

an intake passageway for intake air;

a throttle lever including a throttle pivot point and a throttle linkage aperture, the throttle linkage aperture and the throttle pivot point defining a first axis having a first side and a second side;

a throttle valve disposed in the intake passageway to control the flow of intake air, the throttle valve movable in response to movement of the throttle lever;

a throttle linkage positioned to directly or indirectly connect the air vane and the throttle lever, the throttle linkage and the movable air vane disposed on the first side of the first axis; and a resilient member directly or indirectly connected to the stationary member, and to the throttle lever at a resilient member aperture that is located on the throttle lever on the second side of the first axis, the resilient member configured to apply a force to bias the resilient member aperture in a first direction away from the flywheel.

2. The engine of claim 1, wherein the throttle lever is pivotable between a wide open throttle position and a closed position, and wherein the biasing force biases the throttle lever in the first direction toward the wide open throttle position.

3. The engine of claim 2, wherein the throttle pivot point and the resilient member aperture define a second axis, wherein the resilient member defines a third axis, and wherein an angle formed between the second axis and the third axis when the throttle lever is in the closed position is less than ninety degrees.

4. The engine of claim 3, wherein the angle is about sixty-five degrees.

5. The engine of claim 1, wherein the resilient member aperture is between 0.041 inches (1.04 mm) and 0.060 inches (1.52 mm) in diameter.

6. The engine of claim 1, wherein the resilient member includes a spring.

7. The engine of claim 6, wherein the spring is the only resilient member directly or indirectly connected to the throttle lever.

8. The engine of claim 1, wherein the movable air vane applies a second force to the throttle lever, the force and the second force being substantially balanced about the pivot point during engine operation at a predetermined speed.

9. An engine comprising:

a stationary member;

a crankshaft supported for rotation by the stationary member;

an intake passageway for intake air;

a throttle valve disposed in the intake passageway;

a throttle lever pivotable about a pivot point to move the throttle valve;

an air vane governor including a movable air vane, the movable air vane operable to pivot the throttle lever between a wide open position and a closed position; and a single resilient member that forms at least a portion of a connection between the stationary member and the throttle lever, the resilient member configured to apply a force to the throttle lever to bias the throttle lever toward the wide open position.

10. The engine of claim 9, wherein the air vane governor includes a fan having a plurality of fins, the fan rotating in response to rotation of the crankshaft.

11. The engine of claim 10, wherein the movable air vane includes a surface that deflects air from the fins.

12. The engine of claim 9, wherein the movable air vane applies a second force to the throttle lever, the force and the second force being substantially balanced about the pivot point during engine operation at a predetermined speed.

13. The engine of claim 9, wherein the engine also includes a throttle linkage that forms at least a portion of a connection between the air vane and the throttle lever and connects at a throttle linkage aperture on the throttle lever.

14. The engine of claim 13, wherein the throttle pivot point and the throttle linkage aperture define a first axis, and wherein the throttle linkage and the movable air vane are located on a first side of the first axis.

15. The engine of claim 14, wherein the biasing member is located on a second side of the first axis opposite the first side.

16. The engine of claim 14, wherein the resilient member is connected to the throttle lever at a resilient member aperture on the throttle lever, and wherein the resilient member aperture is located on a second side of the first axis.

17. The engine of claim 16, wherein the resilient member aperture and the throttle pivot point define a second axis, wherein the resilient member defines a third axis, wherein the throttle lever is pivotable between the wide open position and the closed position, and wherein an angle formed between the second axis and the third axis when the throttle lever is in the high speed no load position is less than ninety degrees.

18. The engine of claim 17, wherein the angle is about sixty-five degrees.

19. The engine of claim 9, wherein the resilient member includes a spring.

20. An engine comprising:

a stationary portion;

a crankshaft supported by the stationary portion and rotatable at a first speed in response to the combustion of an air-fuel mixture;

a fan rotatable at a second speed that is proportional to the first speed in response to rotation of the crankshaft;

an air vane positioned adjacent the fan and pivotable about a pivot axis in response to rotation of the fan;

a throttle lever pivotally supported for rotation about a throttle axis and including a throttle linkage aperture that cooperates with the throttle axis to define a first axis having a first side and a second side, the throttle lever movable between a first position and a second position to vary the first speed;

a linkage that forms at least a portion of a connection between the air vane and the throttle lever such that the throttle lever moves in response to movement of the air vane, the linkage and the air vane disposed on the first side of the first axis; and a resilient member that forms at least a portion of a connection between the stationary member and the throttle lever, the resilient member disposed on the second side of the first axis.

21. The engine of claim 20, wherein the linkage extends from the throttle linkage aperture in a first direction and the resilient member extends from a resilient member aperture in a second direction that is substantially opposite and parallel to the first direction.

22. The engine of claim 21, wherein an angle defined between the first direction and the second direction is below 30 degrees.

23. The engine of claim 20, wherein the resilient member aperture and the throttle pivot point define a second axis, the resilient member defines a third axis, and wherein an angle formed between the second axis and the third axis when the throttle lever is in the first position is less than ninety degrees.

24. The engine of claim 23, wherein the angle is about sixty-five degrees.

25. The engine of claim 20, wherein the linkage applies a first force to the throttle lever and the resilient member applies a second force to the throttle lever, the first force and the second force being balanced about the pivot point when the engine operates at a predetermined speed.

* * * * *